US005868525A

United States Patent [19]

Takahashi

[11] Patent Number: 5,868,525

[45] Date of Patent: Feb. 9, 1999

[54] METHOD OF PREVENTING DAMAGES TO LOOSE SAND GROUND OR SANDY GROUND DUE TO SEISMIC LIQUEFACTION PHENOMENON, AND OF RESTORATION OF DISASTER-STRICKEN GROUND

[75] Inventor: Yuichiro Takahashi, Niigata, Japan

[73] Assignee: Takao Enterprise Co., Ltd., Niigata, Japan

[21] Appl. No.: 747,662

[22] Filed: Nov. 13, 1996

[30] Foreign Application Priority Data

Nov. 13, 1995 [JP] Japan ..... 7-329389

[51] Int. Cl.[6] ..... E02D 3/12

[52] U.S. Cl. ..... 405/263; 405/258

[58] Field of Search ..... 52/741.11; 405/258, 405/263, 266

[56] References Cited

U.S. PATENT DOCUMENTS

| | | | |
|---|---|---|---|
| 1,987,626 | 1/1935 | Klie . | |
| 3,386,251 | 6/1968 | Casagrande et al. | 405/258 |
| 3,971,222 | 7/1976 | Griffith, Jr. | 405/263 |
| 4,084,381 | 4/1978 | Cain et al. | 405/266 |
| 4,309,129 | 1/1982 | Takahashi . | |
| 4,470,727 | 9/1984 | Ritter | 405/267 |
| 4,540,316 | 9/1985 | Takahashi . | |
| 4,911,584 | 3/1990 | Arenzana | 405/264 |

OTHER PUBLICATIONS

GKN Keller GMBH, "Stopfverdichtung" Special Brochure Extract From Specialtiefbau, Offenbach, DE, XP002025635 (May 22, 1993).

*Primary Examiner*—Terry Lee Melius
*Assistant Examiner*—Gary S. Hartmann
*Attorney, Agent, or Firm*—Birch, Stewart, Kolasch & Birch, LLP

[57] ABSTRACT

To protect ground composed of loose sand or sandy soil, and structures constructed thereon against seismic liquefaction disasters, said ground is improved and reinforced by a four-stage method. At the first stage, a specially formulated mortar impregnating material is injected by a specific impregnating machine through a given array of injection points into the ground to achieve a first effect by the first impregnation by consolidation. At the second stage, an injection pipe having a distal penetrating end unit is forced or driven into the ground to obtain pile-like compression effect. At the third stage, a specially formulated cement impregnating material is injected into the ground to obtain a third or consolidation effect. At the fourth stage, the impregnation of the cement material under pressure causes soil particles to be solidified by the penetration thereof.

4 Claims, 7 Drawing Sheets

METHOD OF PREVENTING DAMAGES TO LOOSE SAND GROUND OR SANDY GROUND DUE TO SEISMIC LIQUEFACTION PHENOMENON, AND OF RESTORATION OF DISASTER-STRICKEN GROUND

BACKGROUND OF THE INVENTION

1. Field of the Invention

The present invention relates to a method of reducing, or substantially preventing, ground disaster caused by a liquefaction phenomenon likely to occur in naturally stratified grounds composed of loose sand or sandy soil, piled grounds, filled-up grounds, and so on during earthquakes, and for restoration or reconstruction of disaster-stricken ground areas.

2. Description of the Prior Art

For Japan or a country where large cities are concentrated on seaside open fields made up of soft grounds, it is of vital importance to reconstruct soft grounds or provide for measures to fend off earthquake disasters when infrastructures such as water fronts, and slope fronts are developed, or put in good condition.

So far, the following countermeasures have been taken to prevent the aforesaid liquefaction.

(i) Easy-to-liquefy soil is dug out, and replaced by gravelly material of good water permeability.

(ii) Ground is compacted as by means of vibration rollers, vibroflotation methods, or sand compaction piles to increase the density and strength of loose sand or sandy soil.

(iii) By use of pile foundation, piles are driven through an easy-to-liquefy stratum or a stratum portion expected to liquefy into a stable sub-stratum.

(iv) Although depending on constructional, and environmental conditions, a piling structure is laid on ground or an underground water level is lowered to increase underground effective stress.

(v) When a filled-up ground is created, finely particulate soils are often used for reclaiming material usually by means of a sand pump. Such reclaiming material is substituted by difficult-to-liquefy soils made up of coarse soil particles.

(vi) Sand drains or gravel drains composed of coarse material are set up on ground expected to liquefy to thereby dissipate excess pore water produced during an earthquake.

Referring to an impregnating material used to obtain the first effect according to the present invention, as set forth in claim 1, the following standard mortar formulations may be used as standard grout composition although the inventive method is quite distinguishable over currently available methods.

TABLE 1

Standard Mortar Formulations
% by weight per 1,000 liters upon mixed

| Material | Weight Ratio C:S:W 1:1:0.55 | 1:2:0.65 | *1:3:0.75 | Marginalia |
|---|---|---|---|---|
| Normal Portland cement in kg | 803.4 | 580.7 | 454.7 | |
| Standard sand in kg | 803.4 | 1,161.4 | 1,364.0 | |

TABLE 1-continued

Standard Mortar Formulations
% by weight per 1,000 liters upon mixed

| Material | Weight Ratio C:S:W 1:1:0.55 | 1:2:0.65 | *1:3:0.75 | Marginalia |
|---|---|---|---|---|
| Dispersant in kg | — | — | — | 0.25%/cement wt. |
| Water in kg | 441.9 | 377.5 | 341.0 | |

Note: The cement and standard sand used have a true specific gravity of 3.15 and 1.65, respectively.

Referring to an impregnating material composed of cement (C) and water (W) at a C to W ratio of 1:0.47, the following cement paste formulations are used as standard grout composition.

TABLE 2

Cement Paste Formulations
% by weight per 200 liters upon mixed

| Material | Weight Ratio C:W 1:10 | 1:8 | 1:6 | 1:4 | 1:2 | 1:1 |
|---|---|---|---|---|---|---|
| Normal Portland cement in kg | 19.38 | 24.05 | 31.67 | 46.32 | 86.30 | 151.80 |
| Water in kg | 193.80 | 192.37 | 190.00 | 185.30 | 172.60 | 151.80 |

Note: The cement used had a true specific gravity of 3.15.

Even upon built up on soft ground or filled-up ground not fully reconstructed by the means set forth in (i), (ii), (iii), (iv) and (v), ferro-concrete structures or skyscrapers are little, if any, hit by the liquefaction phenomenon caused by earthquakes, because pile foundations are often used for their foundation. If ground zones between the pile foundations or ground zones adjoining to the structures are liquefied, however, vital functions such as water pipes, gas pipes, and sewers, all called in Japan life lines, will be unavoidably broken or cut off.

Reference is made, on the other hand, to riparian structures, which are most likely to be hit by earthquakes although depending on their magnitude. If the foundation for banks alongside rivers is replaced by gravelly material or reinforced with drain material to prevent its liquefaction, there will then be a possibility that the banks are broken for reasons of flood waters, and unusual floods because water-permeable ground is formed beneath the levees. Riparian structures such as floodgates, and conduit pipes, too, are likely to suffer from damages such as subsidence, transversal flowing, and cracking between pile structures and a piling structure for the banks, because such phenomena as mentioned above arise.

Furthermore for naturally stratified ground with easy-to-liquefy loose sand or sandy soil placed thereon in the form of a thick layer or a wide area of created ground, it is required to reconstruct them by methods that enable the required minimum effect to be achieved in an economical manner.

A primary object of the present invention is to provide a solution to the aforesaid problems, and eliminate the problem set forth in (iv) above in view of constructional and environmental considerations.

SUMMARY OF THE INVENTION

According to the present invention, the aforesaid object is achieved by the provision of a method of reducing or substantially preventing disasters caused by a seismic liquefaction phenomenon of a loose sand or sandy ground, and of restoration or reconstruction of a disaster-stricken ground, comprising:

a first stage of using an impregnating machine having nozzle orifices to inject a given amount of an impregnating material composed of cement or C, sand or S, bentonite or B, and water or W at a weight C:S:B:W ratio of 1:3.57–2.74:0.014–0.0095:1.19–10.3 into a ground made up of loose sand or sandy soil through injection points defined by apexes a plurality of polygonal zones, each having a side of 0.5 to 3.0 meters in length, said given amount of impregnating material being determined depending on a degree of softness of said loose sand ground or sandy ground, thereby achieving a first or consolidating effect according to which the ground is so consolidated that pore water is discharged therefrom in an amount corresponding to the amount of the impregnating material injected, resulting in a decrease in a void ratio of the ground and an increase in a density of the ground, a second stage of forcing or driving a plurality of injecting pipes, each having a forcing or driving penetration end device, into injection points located at centers of said plurality of polygonal zones to a predetermined depth, thereby achieving a second or piling effect according to which sand or sandy soil of ground portions corresponding to cylindrical volumes of regions found by sectional areas of the devices x the predetermined depth are compressed so that the void ratio of the ground decreases with a further increase in the density of the ground, and a third stage of injecting a given amount of an impregnating material composed of cement or C and water or W at a weight C:W ratio of 1:0.59–0.46 from said predetermined depth at which said penetration end devices are located to a depth range of 0.1 to 1.0 meter while the injecting pipes are pulled up plural times at a stepwise interval, said given amount of the impregnating material being determined depending upon the degree of softness of the loose sand ground or sandy ground, thereby achieving a third or consolidation effect according to which the ground is further consolidated so that pore water is discharged therefrom in an amount corresponding to the amount of the impregnating material injected, resulting in a further decrease in the void ratio of the ground and a further increase in the density of the ground, and a fourth or penetration and solidification effect of the impregnating material injected under pressure controlled depending on the degree of softness of the loose sandy ground or sand ground, according to which voids between loose sand or sandy particles are filled so that the ground is solidified over a penetration range of 2 to 5 meters in diameter, resulting in a still further increase in the density of the ground, said first to fourth effects producing a composite and synergistic action on reducing or substantially preventing damages to the loose sand or sandy ground due to the seismic liquefaction phenomenon, and on restoration or reinforcement of a disaster-stricken ground.

DETAILED DESCRIPTION OF THE PREFERRED EMBODIMENTS

Figure 1:
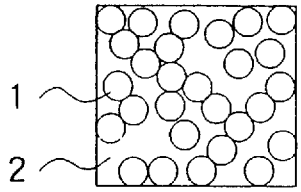
FIG. 1 is a schematic of soil particles, and voids between soil particles.
Figure 2:
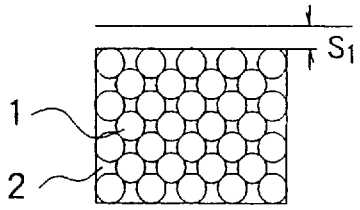
FIG. 2 is a schematic of soil particles, and voids between soil particles.
Figure 3:
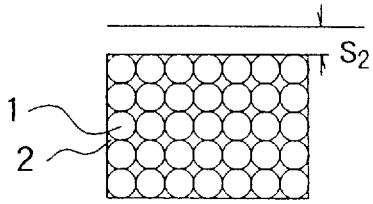
FIG. 3 is a schematic of soil particles, and voids between soil particles.
Figure 4:
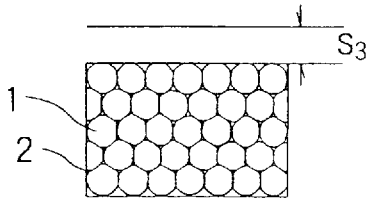
FIG. 4 is a schematic of soil particles, and voids between soil particles.

The present invention will now be explained at great length with reference to the accompanying drawings.

By the application of the aforesaid means, ground having an N or Nd value of up to 4, and composed of loose sand or sandy soil and so likely to liquefy can be selectively reconstructed in the form of (1) a first class of ground having an N or Nd value of 5 to 10, (2) a second class of ground having an N or Nd value of 10 to 30, and a third class of ground having an N or Nd value of at least 30. While expected damage to ground is taken into consideration, it is thus possible to reconstruct the ground depending on purpose from the standpoints of security, priority, and urgency.

The N value is used to make estimation of the degree of hardness or softness of ground, the supporting strength of a structure, and so on. To this end, according to a sort of dynamic sounding testing a weight of 63.5 kg is allowed to drop gravitationally from a height of 75 cm to find the number of driving required to penetrate a standard penetration testing machine (called a Raymond sampler) to a depth of 30 cm.

The Nd value is used to make estimation of the degree of hardness or softness of ground, the supporting strength of a structure, and so on. To this end, a sort of dynamic sounding testing is performed, as is the case with the standard penetration testing, to gravitationally drop a weight of 63.5 kg from a height of 75 cm to thereby find the number of driving needed to penetrate a circular cone (with an apex angle of 60°) equal in contour to the Raymond sampler for the standard penetration testing to a depth of 30 cm.

In connection with the relation between the N and Nd values, it is noted that N=Nd for sandy ground.

Japan occupies a very high place in the world as the earthquake country, and there are two leading causes for seismic disasters, one relating to the earthquake resistance of structures and another to the foundation of structures.

The present invention is primarily directed to the foundation of structures. So far, Japan has had many examples of disaster caused by the seismic liquefaction of saturated loose sand or sandy grounds. The liquefaction is understood to refer to a phenomenon where soil particles are liquefied by an increase in the pressure of underground pore water due to an earthquake, and lose resistance to external force. As well known in the art, even normal material often loses resistance upon subjected to external force. The seismic liquefaction is a phenomenon inherent in soil in that a decrease in the effective stress of ground results incidentally in ground destruction. Loose sand or sandy soil is low in terms of bonding force between particles. In particular, soil of noticeable negative dilatancy is different from viscous soil or sand of high density and, upon subjected to liquefaction, loses their resistance completely in a state where its effective stress is reduced to zero, and so suffers from various forms of damage at various scales although depending on seismic magnitude and conditions.

The dilatancy is understood to refer to a phenomenon where, upon destroyed by shearing strength due to seismic or other external force, soil changes in volume due to a change in the alignment of soil particles. Loose sand or sandy soil has a negative dilatancy because it contracts, whereas compacted sand or sandy soil has a positive dilatancy because it expands.

From the aforesaid standpoint, a number of field experiments were repeated for easy-to-liquefy ground composed of loose sand, as shown schematically in FIG. 1, so that the density and strength of the ground could be increased by ground improvement, thereby reducing or substantially preventing the liquefaction of the ground. The results of ground improvement are shown in the following Table 3, wherein three categories of ground upon improved are indicated together with relative density, void ratio, N value, and Nd value for the purpose of comparison.

TABLE 3

| | Original ground | Ground upon improved 1st-class | 2nd-class | 3rd-class |
|---|---|---|---|---|
| Relative density Dγ | <0.2 | 0.3–0.4 | 0.4–0.6 | 0.6–≧0.8 |
| Void ratio % | 70–60 | 60–50 | 50–40 | 40–≦30 |
| N value & Nd value | <4 | 5–10 | 10–30 | ≧30 |

The original ground was composed of easy-to-liquefy sand or sandy soil.

FIGS. 1, 2, 3 and 4 are respective schematics of the original ground, and the first, second, and third class of ground upon improved, each composed of soil particles, and voids between soil particles. Reference numeral 1 represents soil particles, 2 voids between soil particles, and $S_1$, $S_2$ and $S_3$ stand for the amounts of compression of the original ground shown in FIG. 1.

Figure 5:
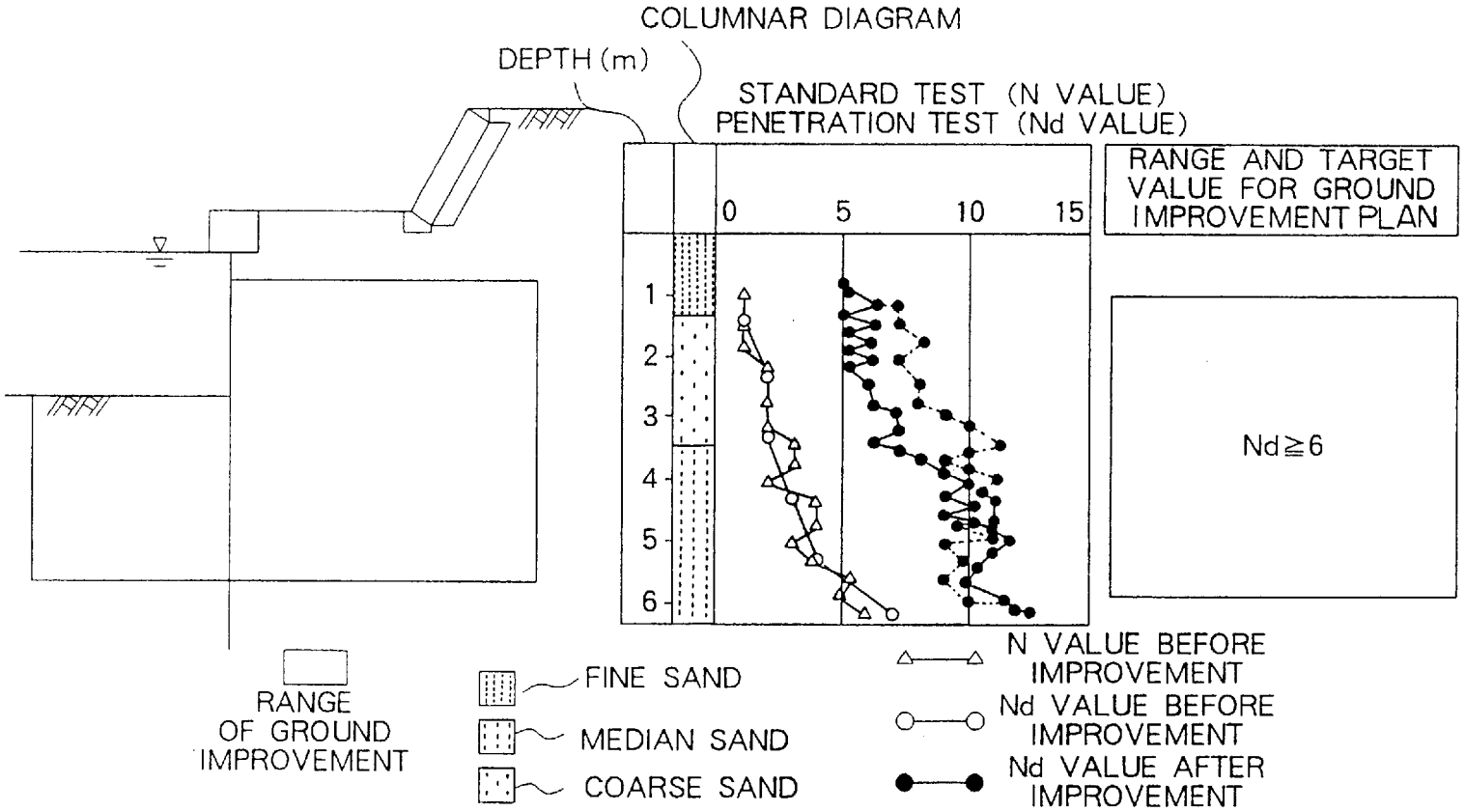
FIG. 5 is a diagram showing the results of a survey made of the improved ground.
Figure 6:
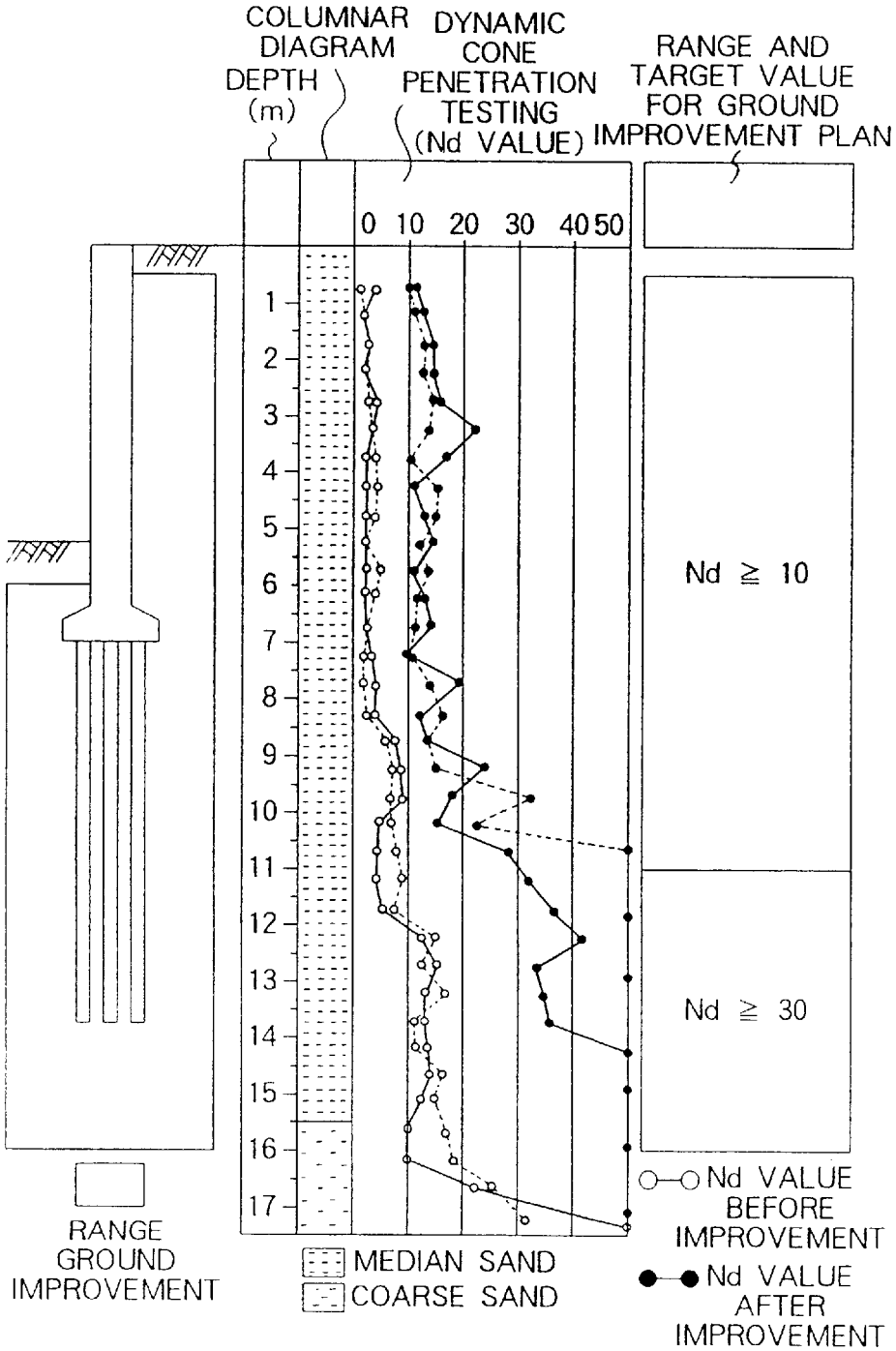
FIG. 6 is a diagram showing the results of a survey made of the improved ground.

Shown in FIGS. 5 and 6 are the results of surveys on the grounds upon improved.

Figure 12:
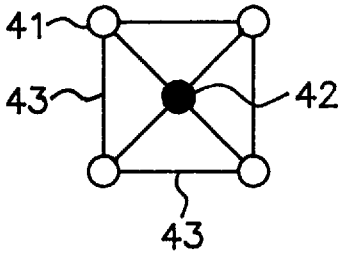
FIG. 12 is a schematic of a standard array of injection points for the first category of improved ground.
Figure 13:
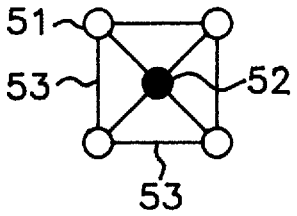
FIG. 13 is a schematic of a standard array of injection points for the second category of improved ground.
Figure 14:
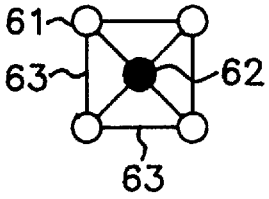
FIG. 14 is a schematic of a standard array of injection points for the third category of improved ground.

As already mentioned, at the first stage of the invention an impregnating unit having nozzle orifices is used to inject a given amount of impregnating material composed of cement or C, sand or S, bentonite or B, and water or w at a weight C:S:B:W ratio of 1:3.57–2.74:0.014–0.0095:1.19–10.3 into a ground made up of loose sand or sandy soil and so expected to liquefy during an earthquake through four injection points defined by apexes of a square zone, having a side of 1.0 to 2.5 meters in length, as shown in FIGS. 12, 13, and 14, thereby achieving a first or consolidating effect according to which the ground is so consolidated that pore water is discharged therefrom in an amount corresponding to the amount of the impregnating material injected, resulting in a decrease in the void ratio of the ground and an increase in the density of the ground.

At the second stage of the invention a plurality of injecting pipes, each having a forcing or driving penetration end unit, are forced or driven into injection points located at centers of the square zone to a predetermined depth, thereby achieving a second or piling effect according to which sand or sandy soil of ground portions corresponding to cylindrical volumes of regions found by a sectional area of the unit x the predetermined depth are compressed so that the void ratio of the ground decreases with a further increase in the density of the ground.

At the third stage of the invention an impregnating material composed of cement or C and water or W at a weight C:W ratio of 1:0.59–0.46 from said predetermined depth at which said penetration end unit is located to a depth range of 0.1 to 1.0 meter at a given controlled injection pressure while the injecting pipes are pulled up, thereby achieving a third or consolidation effect according to which the ground is further consolidated so that pore water is discharged therefrom in an amount corresponding to the amount of the impregnating material injected, resulting in a further decrease in the void ratio of the ground and a further increase in the density of the ground, and a fourth or penetration and solidification effect of the impregnating material injected under pressure, according to which voids between loose sand or sandy particles are filled so that the ground is solidified over a penetration range of 2 to 5 meters in diameter, resulting in a still further increase in the density of the ground.

The aforesaid first to fourth effects produce a composite and synergistic action on reducing or substantially preventing damages to the loose sand or sandy ground due to the seismic liquefaction phenomenon. Earthquake-stricken ground, too, can be reconstructed in the form of ground resistant to damage due to liquefaction.

Figure 7:
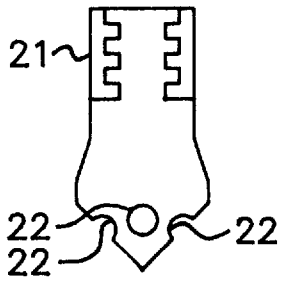
FIG. 7 is a schematic of a distal injection machine used for the second, and fourth impregnation by consolidation.

FIG. 7 is a schematic of one exemplary impregnating unit having a distal penetrating end used for the second, and fourth consolidation injection, wherein reference numeral 21 represents a threaded portion to mate with an injection pipe, and 22 four to six nozzle orifices.

Figure 8:
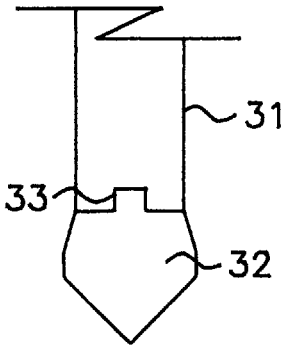
FIG. 8 is a schematic of a distal forcing or driving machine used for achieving pile-like compression effect.

FIG. 8 is a schematic of a distal end of one exemplary forcing or driving unit designed to obtain pile-like compression effect, wherein reference numeral 31 represents an injection pipe and 32 a driving unit, which can be separated from the injection pipe at a portion 33 upon reaching a given depth.

Figure 9:
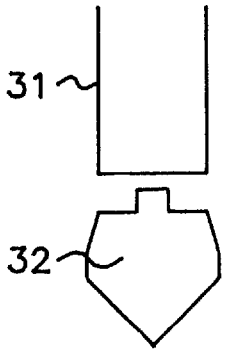
FIG. 9 is a schematic of an injection pipe separated from a penetrating machine.
Figure 10:
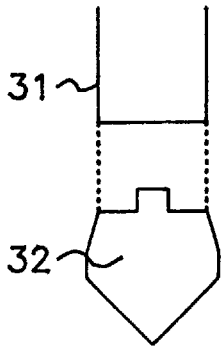
FIG. 10 is a schematic of the injection pipe being pulled up upon disengaged from the penetrating machine.

FIG. 9 is a schematic of the driving unit 32 disengaged from the injection pipe 31, and FIG. 10 is a schematic of the injection pipe 31 being pulled up upon disengaged from the driving unit 32.

Figure 11:
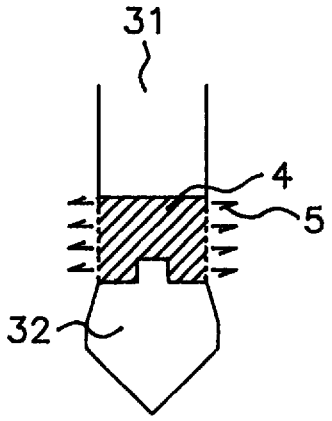
FIG. 11 is a schematic of the ground being impregnated while the injection pipe is pulled up.

FIG. 11 is a schematic of the ground being impregnated while the injection pipe 31 is pulled up. An impregnating material 5 is injected from weak points into a cylindrical range 4, thereby achieving consolidation effect, and effect on impregnation of the material between soil particles. The injection pipe 31 is pulled up at an interval of 0.1 to 1.0 meter in a step-up manner depending on whether the ground is converted to the first, second, or third class of improved ground, and the impregnating material is injected into the ground at a constant pressure determined according to a desired ground improvement plan.

FIG. 12 is a diagram showing a standard array of injection points applied to the first class of improved ground, wherein reference numeral 41 represents injection points for the first impregnation by consolidation, 42 a void injection point for the second impregnation by consolidation and achieving penetration effect, and 43 a standard interval of 2.0 to 2.5 meters between the injection points for the first impregnation by consolidation.

FIG. 13 is a diagram showing a standard array of injection points applied to the second class of improved ground, wherein reference numeral 51 represents injection points for the first impregnation by consolidation, 52 a void injection point for the second impregnation by consolidation and achieving penetration effect, and 53 a standard interval of 1.5 to 2.0 meters between the injection points for the first impregnation by consolidation.

FIG. 14 is a diagram showing a standard array of injection points applied to the second class of improved ground, wherein reference numeral 61 represents injection points for the first impregnation by consolidation, 62 a void injection point for the second impregnation by consolidation and achieving penetration effect, and 63 a standard interval of 1.0 to 1.5 meters between the injection points for the first impregnation by consolidation.

As can be understood from the foregoing, according to the present invention it is possible to selectively reconstruct low-strength ground which is composed of loose sand or sandy soil and so likely to suffer from damage due to seismic liquefaction or, in another parlance, having an N (Nd) value of less than 5 in the form of three categories of improved ground, i.e., of N (Nd)≧5, N (Nd)≧10, and N (Nd)≧30 depending on purpose. Under situations where the Japanese Islands are at the active stage of earthquakes, and so expected to suffer from various forms of damage, the inventive method is believed to make a great contribution to prevention of possible damages to grounds and structures.

What is claimed is:

1. A method of preventing disasters caused by a liquefaction phenomenon of a loose sand ground or a sandy ground upon subjected to an earthquake, and of restoration of a disaster-stricken ground, comprising:

a first stage of using an impregnating machine having nozzle orifices to inject an impregnating material composed of cement or C, sand or S, bentonite or B, and water or W at a weight C:S:B:W ratio of 1:3.57–2.74:0.014–0.0095:1.19–10.3 into a ground made up of loose sand or sandy soil through injection points defined by apexes a plurality of polygonal zones, each having a side of 0.5 to 3.0 meters in length, thereby achieving a first or consolidating effect according to which the ground is so consolidated that pore water is discharged therefrom in an amount corresponding to the amount of the impregnating material injected, resulting in a decrease in a void ratio of the ground and an increase in a density of the ground, a second stage of forcing or driving a plurality of injecting pipes, each having a forcing or driving penetration end device, into injection points located at centers of said plurality of polygonal zones to a predetermined depth, thereby achieving a second or piling effect according to which sand or sandy soil of ground portions corresponding to cylindrical volumes of regions found by sectional areas of the devices x the predetermined depth are compressed so that the void ratio of the ground decreases with a further increase in the density of the ground, and a third stage of injecting an impregnating material composed of cement or C and water or W at a weight C:W ratio of 1:0.59–0.46 from said predetermined depth at which said penetration end devices are located to a depth range of 0.1 to 1.0 meter while the injecting pipes are pulled up plural times at a stepwise interval, thereby achieving a third or consolidation effect according to which the ground is further consolidated so that pore water is discharged therefrom in an amount corresponding to the amount of the impregnating material injected, resulting in a further decrease in the void ratio of the ground and a further increase in the density of the ground, and a fourth or penetration and solidification effect of the impregnating material injected under controlled pressure according to which voids between loose sand or sandy particles are filled so that the ground is solidified over a penetration range of 2 to 5 meters in diameter, resulting in a still further increase in the density of the ground, said first to fourth effects producing a composite and synergistic action on reducing or substantially preventing damages to the loose sand or sandy ground due to the seismic liquefaction phenomenon, and on restoration or reinforcement of a disaster-stricken ground.

2. The method according to claim 1, wherein the impregnating material composed of cement, sand, bentonite, and water and used for achieving the first effect is used at a weight C:S:B:W ratio of 1:3:0.0125:1.05.

3. The method according to claim 1, wherein the impregnating material composed of cement, and water and used for achieving the third, and fourth effect is used at a weight C:W ratio of 1:0.47.

4. The method according to claim 1, wherein an interval between optimum injection points is 2.0 meters for a first category of improved ground having an N or Nd value of 5 to 10, 1.5 meters for a second category of improved ground having an N or Nd value of 10 to 30, and 1.0 meter for a third category of improved ground having an N or Nd value of at least 30, said optimum injection points being located at apexes of a square.

* * * * *